United States Patent [19]

Birkhofer et al.

[11] 4,273,280

[45] Jun. 16, 1981

[54] MACHINE FOR THE ATTACHMENT OF RIVETS, BUTTONS OR THE LIKE ON CLOTHING PIECES

[75] Inventors: Herbert Birkhofer; Gunther Diekhoner; Hans-Otto Hoffler, all of Brunswick, Fed. Rep. of Germany

[73] Assignee: Schaeffer-Homberg GmbH, Wuppertal, Fed. Rep. of Germany

[21] Appl. No.: 48,565

[22] Filed: Jun. 14, 1979

[30] Foreign Application Priority Data

Jun. 16, 1978 [DE] Fed. Rep. of Germany ..... 2826417

[51] Int. Cl.[3] ..... A41H 37/04

[52] U.S. Cl. ..... 227/107; 335/256; 227/131; 227/152

[58] Field of Search ..... 173/117; 335/256, 266, 335/268; 227/15, 16, 17, 18, 107, 131, 31, 32, 38, 152

[56] References Cited

U.S. PATENT DOCUMENTS 3,576,473 4/1971 Genbauffe et al. ..... 335/256 X 3,946,852 3/1976 Cestrieres et al. ..... 335/256 X

FOREIGN PATENT DOCUMENTS 389930 2/1924 Fed. Rep. of Germany ..... 335/256

916559 12/1946 France ..... 227/131

*Primary Examiner*—Paul A. Bell

*Attorney, Agent, or Firm*—Martin A. Farber

[57] ABSTRACT

A machine for the attachment of rivets, buttons or the like on clothing pieces, with an upper tool to be moved onto the lower tool, which upper tool sits on a vertically guided tool ram with electrical drive. Two different strength magnets are coordinated to the upper tool ram, the latter being spring-biased in the reverse direction, such that the weaker electromagnet which sits in the range of a cross-sectionally-smaller step of the upper tool ram surrounds the upper tool ram in ring-like manner and the stronger electromagnet has a core which core forms a pot-shaped recess for moving a plate armature therein, the latter being arranged on the free end of the upper tool ram.

9 Claims, 3 Drawing Figures

MACHINE FOR THE ATTACHMENT OF RIVETS, BUTTONS OR THE LIKE ON CLOTHING PIECES

Figure 1:
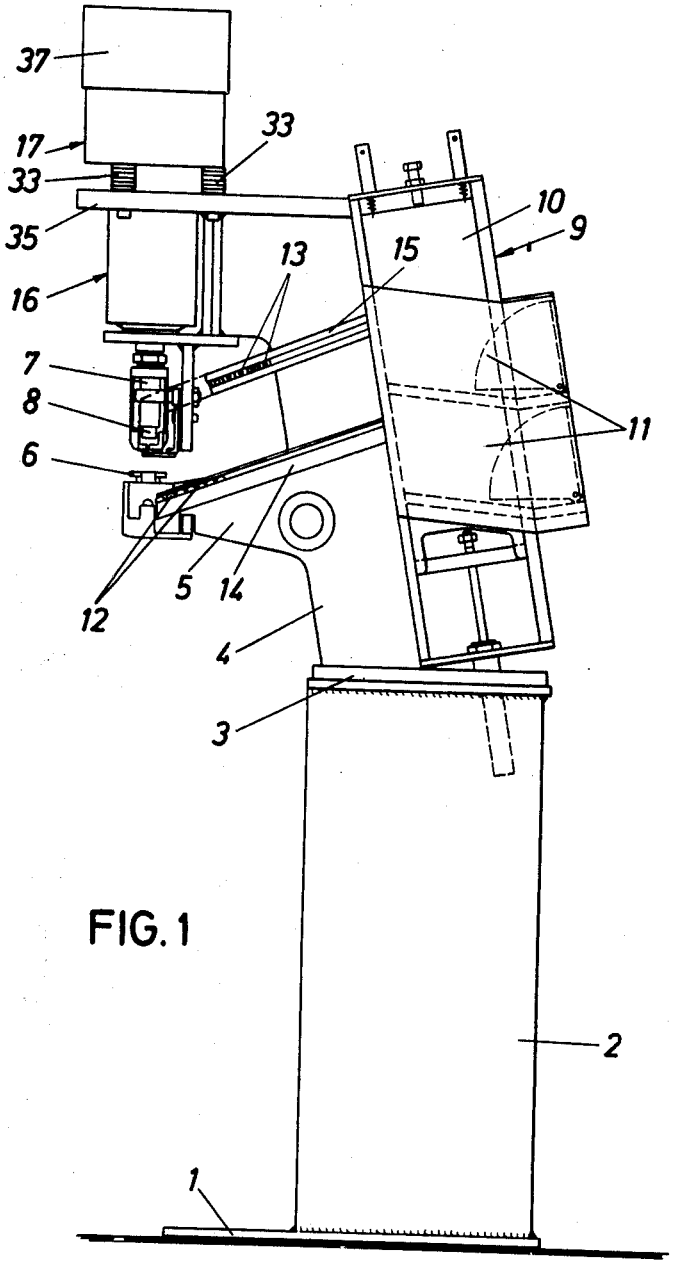

The invention relates to machine for the attachment of rivets, buttons or the like on clothing pieces, with an upper tool to be moved onto the lower tool, which upper tool sits on a vertically guided tool ram with electrical drive.

Electrical drives are known with such machines which have an electromotor which transmits its rotary movement via a belt drive, cam drive or toggle lever or articulated transmission to the vertically guided upper tool ram. Such types of drive are relatively expensive and because of the numerous components are susceptible to failure. Also considerable deviations from the ideal force-path course of the drive are present with respect to the manner of operation of these attachment machines.

The object of the invention is based on the task to form a machine of the previously set forth type in a simple technical production manner such that with a construction using few parts and unsusceptible to failure, the electric drive achieves the ideal force-path course most extensively.

This task is solved in the manner that two different strength magnets are coordinated to the upper tool ram, the latter being spring-biased in the reverse running direction, such that the weaker electromagnet, which weaker electromagnet sits in the range of a cross sectionally-smaller step of the upper tool ram, surrounds the upper tool ram in a ring-like fashion and the stronger electromagnet has a core, which core forms a pot-shaped recess, for the insertion of a plate armature, the latter being arranged on the free end of the upper tool ram.

As a consequence of such formation a machine of the species type of increased serviceability or functional value is set forth. The drive is simple and has few parts in its construction and thus is not prone to failure. Also the ideal force path course of the drive is substantially achieved with respect to the manner of operation of such machines. The weaker electromagnet causes the idling or no-load stroke, and the force of the stronger magnet is utilized for the working stroke: For during the working stroke there occur the perforation of the material which is to be equipped with the rivets and deformation, and respectively, bending over or flanging of the edges of the rivet parts. This coupling of the two unequal strength electromagnets with one another brings about the advantage of an increased number of strokes per minute. The weaker electromagnet causing the idling or no-load stroke builds and decays its magnetic field relatively quickly. The stronger magnet arranged thereover can thereby build up its force field during the rapid stroke which is caused by the weaker magnet, so that this time interval does not represent a performance or efficiency loss on part of the machine. Moreover the assembling or mounting of the electrical drive is very much simplified. Beyond this space saving advantages also result.

A further advantageous feature is characterized in the manner that the plate armature possesses a lower part section of smaller diameter, which lower part section is positively adjusted to the core recess. The air cushion which originates during the downward moving of the plate armature can thereby pass-off edge-sidedly and does not impair the working stroke of the stronger electromagnet.

Moreover it proves of advantage to provide the bottom surface of the recess with a shock absorber plate.

Hereby the adherence or sticking effect between the plate armature and the facing surface of the pot-shaped recess is prevented. Also the working manner thereby is protective. If necessary or if desired a shock absorber ring can also be coordinated to the weaker electromagnet, the upper tool ram penetrating the shock absorber ring.

A danger of accident is extensively prevented by a protection cage, which protection cage surrounds the plate armature over the entire height of its stroke.

Finally it proves advantageous too that the electromagnet housing is fastened to the machine stand or pedestal with the insertion therebetween of a spring packet. The spring packet acts as a damper during an idling actuation of the machine. By a corresponding possibility of variation it is even possible by means of the spring packets to provide a height adjustment of the upper tool.

Figure 2:
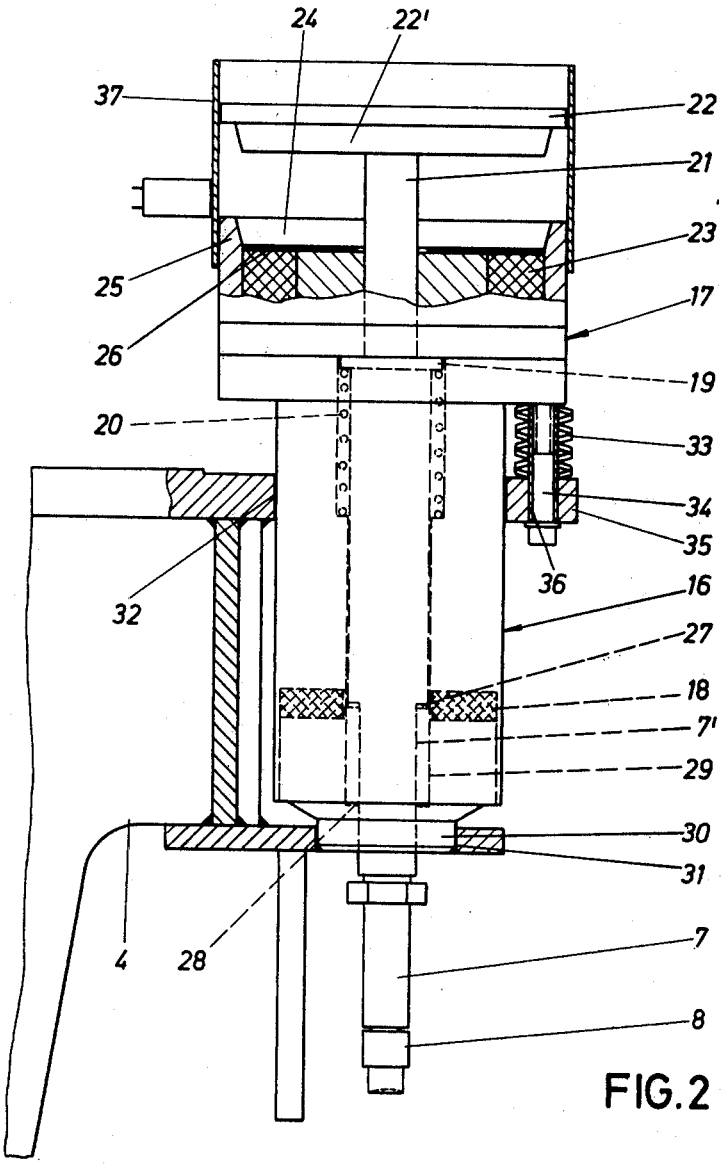
Figure 3:
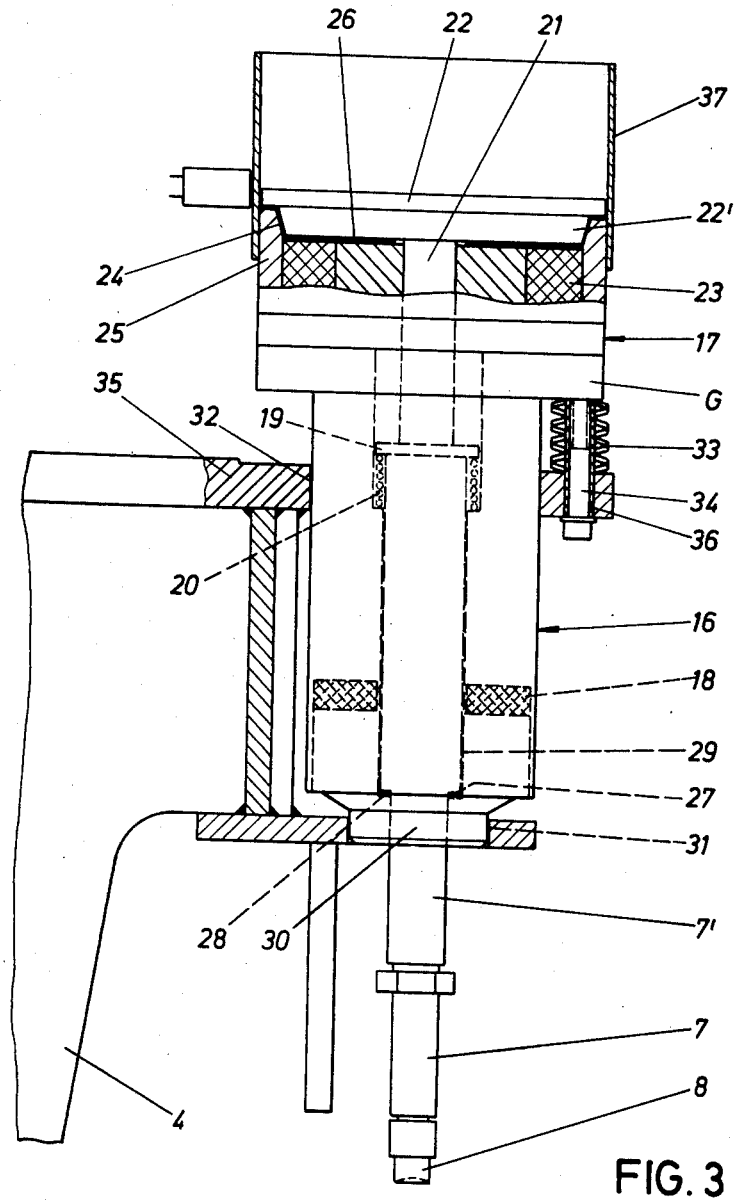

One embodiment example of the invention is explained on the basis of the FIGS. 1–3.

FIG. 1 shows a view of a machine for the attachment of rivets, buttons and the like, which machine is equipped with the electro drive in accordance with the invention, FIG. 2 shows in detailed illustration a longitudinal section in the range of the drive during a moved back position of the upper tool ram, and FIG. 3 shows an illustration corresponding to FIG. 2, however with a moved down upper tool ram.

The machine possesses the machine stand or pedestal 2 which is carried by the base plate 1. The machine housing 4 sits on the cover plate 3 of the stand 2, the projecting arm 5 extending from the machine housing 4 overhanging toward the front. The projecting arm 5 on its front end carries the lower tool 6 which contains the not illustrated lower tool stamp. The upper tool ram 7 extends flush in alignment above the lower tool 6, the free end of the upper tool ram 7 being equipped or tipped with the upper tool stamp 8.

On the rear side the machine housing 4 carries a magazine 9. Laterally of the central slider 10, the magazine 9 forms magazine chambers 11, from which chambers 11 the lower rivet parts 12 and the upper rivet parts 13 are fed via guide rails 14 and 15, respectively, to the lower tool 6 and to the upper tool 8, respectively.

The ram 7 which carries the upper tool 8 obtains its stroke from the electromagnets 16 and 17 which are arranged one over the other. The electromagnet 16 is rated weaker compared to the other electromagnet 17. It possesses the winding 18 which forms the magnetic field, the winding 18 being penetrated by the ram 7 which has a cross-sectionally smaller step 7'. The end of the upper tool ram 7, which end faces the cross-sectionally larger electromagnet 17, is equipped with a collar 19, against which collar a compression spring 20 is supported, which compression spring biases the ram in the reverse direction, thus toward the top. The rod-shaped carrier 21 for the plate armature 22 is connected to the collar 19. The carrier 21 passes through the coil 23 of the electromagnet 17. The coil 23 is received by the core 25 of the electromagnet 17, the core 25 forming a pot-shaped recess 24. The cross-sectional shape of the recess 24 is adjusted positively to the lower part section 22' of the plate armature 22, however the lower part section 22' has a smaller diameter.

The surface of the pot-shaped recess 24, which surface faces the plate armature 22, receives a shock absorber plate 26. Furthermore, the upper tool ram 7, inside of the electromagnet 16, is equipped with a shock absorber ring 27, which ring cooperates or acts jointly with the bottom surface 28 of the penetration opening 29 of the electromagnet 16.

The weaker electromagnet 16 enters with its front-sided projection 30 into a bore 31 of the machine housing 4. Moreover, the electromagnet 16 penetrates opening 32 of the machine housing 4, which opening 32 lies coaxially relative to the bore 31. The support of the electromagnets 16, 17, which electromagnets are connected rigidly with one another by a housing G, takes place by means of springs banks or packets 33 which are arranged in even or uniform angular distribution. The expansion or extension of the spring packets 33 is limited by the screws 34 which extend from the lower side of the electromagnet 17, which screws are supported with their screw heads against the lower side of a plate-shaped stud 35 of the machine housing 4. For improved guidance the screws 34 are surrounded or encircled by bushings 36. By means of the screws 34 a height adjustment of the upper tool can be undertaken or made if desired. The spring packets 33 insure that possible jolts or impacts which emanate from the electromagnets 16, 17 are not directly transferred onto the machine housing 4.

If the machine receives an operating impulse by the person working the machine, the electromagnets 16, 17 cause a downward movement of the upper tool ram 7 against the force of the spring 20. Since the weaker electromagnet 16 forms its force field quicker, it causes the idling or no-load stroke (Leerhub) of the upper tool ram, while the electromagnet 17 which forms its magnetic field more slowly essentially produces the working fastening stroke. However, since during the quicker stroke, caused by the weaker magnet 16, the stronger electromagnet 17 forms its force field, no loss of efficiency or power loss occurs in the machine.

FIG. 3 shows the completely downwardly moved position of the upper tool ram 7. The plate armature 22 has moved with its lower section 22' completely into the core recess 24 of the electromagnet 17, so that its lower side engages the shock absorber plate 26. Moreover, the shock absorber ring 27 steps or moves against the bottom surface 28 of the penetration opening 29 of the electromagnet 16. After completion of the entire stroke of the upper tool ram 7 and decaying or breaking down of the force fields of the electromagnets, the compression spring 20 brings the upper tool ram 7 back into its starting position according to FIG. 2.

A protection cage 37 extending from the upper end of the electromagnet 17 and surrounding the plate armature 22 over its entire stroke height serves for the prevention of accidents.

We claim:

1. In a machine for the attachment of rivets, buttons or the like on clothing pieces, with an upper tool to be moved onto the lower tool, which upper tool is mounted on a vertically guided upper tool ram with electrical drive, the improvement comprising two different strength electromagnets being operatively coordinated to the upper tool ram, means for spring-biasing said upper tool ram in a reverse run direction, said upper tool ram being formed with a cross-sectionally smaller step, the weaker of said electromagnets being disposed in the range of said cross-sectionally-smaller step of said upper tool ram and surrounding said upper tool ram in a ring-like manner, the stronger of said electromagnets has a core, said core forming a pot-shaped core recess, a plate armature being arranged on a free end of said upper tool ram, said plate armature being operatively insertable into said core recess, said core recess is defined by a bottom surface, a shock absorber plate is disposed on said bottom surface.

2. The machine according to claim 1, further comprising a shock absorber ring coordinated to said weaker electromagnet and operatively cooperate with a portion of said ram, said ram extending through said shock absorber ring.

3. In a machine for the attachment of rivets, buttons or the like on clothing pieces, with an upper tool to be moved onto the lower tool, which upper tool is mounted on a vertically guided upper tool ram with electrical drive, the improvement comprising two different strength electromagnets being operatively coordinated to the upper tool ram, means for spring-biasing said upper tool ram in a reverse run direction, said upper tool ram being formed with a cross-sectionally smaller step, the weaker of said electromagnets being disposed in the range of said cross-sectionally smaller step of said upper tool ram and surrounding said upper tool ram in a ring-like manner, the stronger of said electromagnets has a core, said core forming a pot-shaped core recess, a plate armature being arranged on a free end of said upper tool ram, said plate armature being operatively insertable into said core recess, a machine housing, electromagnet housing means for mounting said electromagnets and operatively fastened on said machine housing, at least one spring packet operatively interpositioned between said electromagnet housing means and said machine housing.

4. The machine as set forth in claim 3, further comprising a means for adjusting the height of said upper tool ram fastened on a portion of said machine housing and on said electromagnetic housing means.

5. The machine as set forth in claim 3, further comprising a plurality of said spring packets angularly uniformly distributed about said machine housing and said electromagnet housing means.

6. The machine as set forth in claim 4, wherein said portion of said machine housing is a plate-shaped stud.

7. The machine as set forth in claim 4, wherein said spring packet is mounted on said adjusting means.

8. The machine as set forth in claim 7, wherein said adjusting means comprises a screw adjustably threaded into said electromagnet housing means, said screw includes a screw head abutting a lower surface of said machine housing, said spring packet is disposed on said screw abuttingly between said electromagnetic housing means and said machine housing.

9. The machine as set forth in claim 8, further comprising a bushing disposed around said screw.

* * * * *

UNITED STATES PATENT AND TRADEMARK OFFICE

CERTIFICATE OF CORRECTION

PATENT NO. : 4,273,280

DATED : June 16, 1981

INVENTOR(S) : Herbert Birkhofer, et al

It is certified that error appears in the above-identified patent and that said Letters Patent are hereby corrected as shown below:

ITEM

Column [75] Inventors: "Herbert Birkhofer; Gunther Diekhoner; Hans-Otto Hoffler, all of Brunswick, Fed. Rep. of Germany"

should read

-- Herbert Birkhofer, Günther Diekhöner; Hans-Otto Höffler, all of Braunschweig, Fed. Rep. of Germany--

Signed and Sealed this

*Twenty-fifth* Day of *August 1981*

[SEAL]

*Attest:*

GERALD J. MOSSINGHOFF

*Attesting Officer*

*Commissioner of Patents and Trademarks*